US006230688B1

(12) United States Patent
Faix et al.

(10) Patent No.: US 6,230,688 B1
(45) Date of Patent: May 15, 2001

(54) PROCESS FOR GENERATING HIGH-PRESSURE FUEL AND SYSTEM FOR GENERATING HIGH FUEL PRESSURE

(75) Inventors: Erhard Faix, Gartringen; Marc Westphal, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/297,827

(22) PCT Filed: Sep. 4, 1998

(86) PCT No.: PCT/DE98/02606

§ 371 Date: Jun. 10, 1999

§ 102(e) Date: Jun. 10, 1999

(87) PCT Pub. No.: WO99/13215

PCT Pub. Date: Mar. 18, 1999

(30) Foreign Application Priority Data

Sep. 10, 1997 (DE) ..... 197 39 653

(51) Int. Cl.[7] ..... F02M 37/04

(52) U.S. Cl. ..... 123/495; 123/196 R; 417/372

(58) Field of Search ..... 123/497, 446, 123/196 R, 456, 495, 449, 509; 417/372

(56) References Cited

U.S. PATENT DOCUMENTS 2,670,684 * 3/1954 Fagerholt ..... 417/372
4,082,072 * 4/1978 Johnson ..... 123/495
4,493,623 * 1/1985 Nelson ..... 417/372
4,818,192 * 4/1989 Rorthaus ..... 417/372
5,000,668 * 3/1991 Nakamura et al. ..... 123/449
5,146,895 * 9/1992 Fehlmann ..... 123/495
5,899,136 * 5/1999 Tarr ..... 123/495

FOREIGN PATENT DOCUMENTS

4126640 * 3/1993 (DE) .
4401083 * 7/1995 (DE) .

* cited by examiner

*Primary Examiner*—Carl S. Miller
(74) *Attorney, Agent, or Firm*—Ronald E. Greigg; Edwin E. Greigg

(57) ABSTRACT

A process and system for generating and delivering high-pressure fuel to a high-pressure storage chamber of a fuel injection system of an internal combustion engine. The system includes a low-pressure pump as a pre-feed pump by which fuel is supplied from a tank and is delivered to the intake side of a high-pressure pump and a part of the fuel delivered by the low-pressure pump is used to lubricate the high-pressure pump. In order to reduce the temperature level in the return and to increase the overall efficiency of the motor, the system is embodied so that the delivery quantity of the low-pressure pump or the delivery pressure on the delivery side of the low-pressure pump is controlled as a function of the currently required fuel quantity determined by sensors and a control device. A constant lubrication flow quantity, which is essentially independent of the pressure on the delivery side, is branched off from the delivery flow of the low-pressure pump and a residual remainder flow is delivered to the intake side of the high-pressure pump.

16 Claims, 6 Drawing Sheets

PROCESS FOR GENERATING HIGH-PRESSURE FUEL AND SYSTEM FOR GENERATING HIGH FUEL PRESSURE

PRIOR ART

The invention relates to a process for generating and delivering high-pressure fuel to a high-pressure storage chamber of a fuel injection system, in particular a common rail injection system, of an internal combustion engine, wherein by means of a low-pressure pump as a pre-feed pump, fuel is supplied from a tank and is delivered to the intake side of a high-pressure pump and wherein a part of the fuel delivered by the low-pressure pump is used to lubricate the high-pressure pump.

The delivery volume or the delivery capacity of the low-pressure pump and high-pressure pump must be designed so that a sufficient quantity of high-pressure fuel is always available. However, since the high-pressure pump is usually driven as a function of the motor speed, the available fuel quantity is usually too high in comparison with the required fuel quantity, for example when the driver of a vehicle "lets up on the gas" at a high speed and the vehicle is coasting. The fuel quantity delivered by the high-pressure pump is still very high, but it is not required by the injection system of the internal combustion engine. When a threshold pressure is reached under such circumstances, a pressure regulating valve provided on the high-pressure side is normally opened and a connection to the tank is produced. The fuel is therefore fed in the circuit and is very intensely heated with this high-pressure-side, so-called rail pressure regulation, which is accompanied by dangers. In addition, the use of return lines made of plastic is critical and the overall motor efficiency decreases with high power consumption by the high-pressure pump.

Based on this, the object of an invention is to improve the process of the type mentioned at the beginning so that the above-mentioned disadvantages do not occur, that is in particular a reduction of the high temperature level in the return and in the tank as well as an improvement of the overall motor efficiency is therefore achieved. Furthermore, however, a sufficient and dependable lubrication of the high-pressure pump with fuel should be assured in all operating states and speeds.

BRIEF SUMMARY OF THE INVENTION

This object is attained according to the invention with a process of the type mentioned above by virtue of the fact that the delivery quantity of the low-pressure pump or the delivery pressure on the delivery side of the low-pressure pump is controlled as a function of the currently required fuel quantity determined by sensors and a control device and that a constant lubrication flow quantity, which is essentially independent of the pressure on the delivery side, is branched off from the delivery flow of the low-pressure pump and a residual remainder flow is delivered to the intake side of the high-pressure pump.

This kind of a suction throttle regulation of the high-pressure pump achieves:the fact that the fuel quantity delivered by the high-pressure pump always corresponds to the required fuel quantity of the internal combustion engine so that in the ideal case, no fuel is delivered into the circuit. The actuating variables, for example the position of the gas pedal, are detected by sensors, the currently required fuel quantity is determined in an evaluation and control device, and the delivery quantity of the low-pressure pump (volume flow control) or the delivery pressure on the delivery side of the low-pressure pump (delivery pressure control) is correspondingly predetermined. In a particularly preferred manner, these preset values are also regulated. Since a constant lubrication flow quantity that is essentially independent of the pressure on the delivery side is branched off from the delivery flow of the low-pressure pump, for example on an order of magnitude of 30 l/h, it is achieved according to the invention that even with the above-described low-pressure-side demand regulation of the fuel delivery, a dependable lubrication of the high-pressure pump is assured. The lubricant quantity supplied to the high-pressure pump is independent of the speed of the high-pressure pump and is branched off by means of a flow regulating valve which is embodied so that a constant lubricant quantity that is essentially independent of the inflow pressure is "allowed to pass through". With changes of the inflow pressure between 0 and 6 bar, the lubricant quantity supplied changes by less than 100%.

According to the first embodiment of the invention, if the delivery quantity of the low-pressure pump is controlled and is regulated in a preferred manner (volume flow regulation), then this can be achieved by means of controlling or regulating the speed of the low-pressure pump. In a particularly advantageous manner, the speed of the low-pressure pump is detected by means of a speed sensor and the signal of the speed sensor is sent back to the control device so that the speed which is to be set in accordance with the volume required is set in a regulated manner.

According to the second embodiment of the invention, if the delivery pressure on the delivery side of the low-pressure pump is adjusted or regulated as a function of the required fuel quantity (delivery pressure regulation), then with the use of a low-pressure pump that can be pressure regulated, this can be achieved because the pump is controlled directly by the control device. The delivery pressure on the delivery side of the low-pressure pump, however, can also be realized by controlling a variable throttle device provided at the outlet of the low-pressure pump, for example by moving a throttle slide valve. However, a synchronized solenoid valve in a pressure relief line, which connects the delivery side of the low-pressure pump to the tank, can also be controlled in order to keep the pressure on the delivery side of the low-pressure pump at the desired value determined by the control device. In such an instance, fuel would be fed in a circular fashion in the low-pressure circuit, which does not lead to a disadvantageous power consumption by the low-pressure pump or to a disadvantageous heating of the fuel.

Another object of the present invention is to supply a system for generating high fuel pressure, with which the process according to the invention can be carried out.

This object is attained by means of a system with the features set forth herein for carrying out the volume flow control or regulation and with other features set forth for carrying out the delivery pressure control or regulation.

Through the use of a low-pressure pump that can preferably be speed controlled and in a very particularly preferable manner, can be speed regulated, a volume flow in the low-pressure pump can be set that corresponds to the currently required fuel quantity and the flow regulating valve provided on the delivery side of the low-pressure pump assures a constant lubricant supply of the high-pressure pump.

To preset the delivery pressure on the delivery side of the low-pressure pump, a low-pressure pump can be used that can be pressure regulated. However, it also turns out to be advantageous if, for example, a gear pump is provided, with a variable throttle device connected after it, which can then be controlled by the control device. In such a case, pressure sensors are advantageously provided, which cooperate with the control device to form a pressure regulation circuit.

It would also be conceivable for a branch line to lead from the delivery side of the low-pressure pump back to the tank, which line has a synchronized solenoid valve that can be controlled by the control device.

With the above-explained use of a variable throttle device or a returning branch line with a controllable valve, a non-regulatable low-pressure pump can be used, wherein the pressure regulation occurs at a subsequent location by means of the throttle device or by controlling the solenoid valve.

Other features, details, and advantages of the invention ensue from the claims, the graphic depiction, and the subsequent description of the system according to the invention and the process according to the invention for generating high fuel pressure.

DETAILED DESCRIPTION

Figure 1:
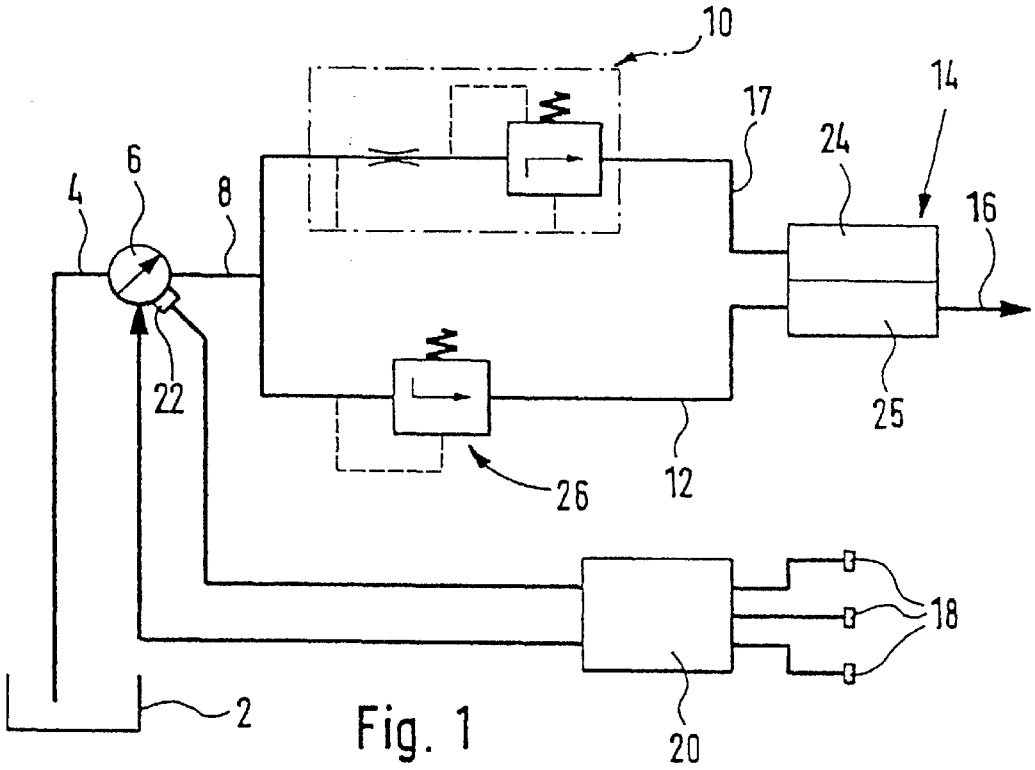
FIG. 1 is a schematic representation of the low-pressure circuit of the system according to the invention for generating high fuel pressure with volume flow control.

FIG. 1 schematically depicts the low-pressure circuit of a system for generating high fuel pressure, with a demand regulation that is produced in the low-pressure circuit and is for the fuel metering of the high-pressure pump. A line 4 leads from a fuel tank 2 to the intake side of a low-pressure pump 6. The delivery side 8 of the low-pressure pump 6 is connected to a flow regulating valve 10 and parallel to this, is connected to the intake side 12 of a high-pressure pump, which is indicated in block form with the reference numeral 14 and whose high-pressure side 16 leads to a high-pressure chamber 40 of a fuel injection system. The flow regulating valve 10 leads to the lubrication circuit 17 of the high-pressure pump 14.

Furthermore, a control device 20 that cooperates with a number of sensors 18 is provided, in which the current fuel requirements of the internal combustion engine are determined and a control signal is correspondingly produced. The control signal is supplied to the low-pressure pump 6, which is embodied as an electric fuel pump, as a control signal for its speed. A speed sensor 22 supplies a measurement value to the control device 20 and this value is processed there in order to regulate the speed and therefore the volume flow of the low-pressure pump 6.

Via the flow regulating valve 10, a lubricant flow that is essentially independent of the inlet pressure and the speed of the high-pressure pump branches off from the fuel quantity delivered by the low-pressure pump 6 and is conveyed into the inner pump housing 24 of the high-pressure pump 14 via the lubrication circuit 17. The remaining quantity is fed by way of the intake side 12 into the intake chamber 25 of the high-pressure pump 14, and from there is fed into the rail. The volume flow of the low-pressure pump 6 that has been calculated by the control device 20 in accordance with the required fuel quantity is delivered by the electric fuel pump that can be speed regulated.

Furthermore, a safety valve 26 is depicted, which interrupts the fuel delivery to the high-pressure pump 14 when the pressure falls below a predetermined level of approximately 1 bar so that in the event of a leak or the like, the motor is switched off.

Figure 2:
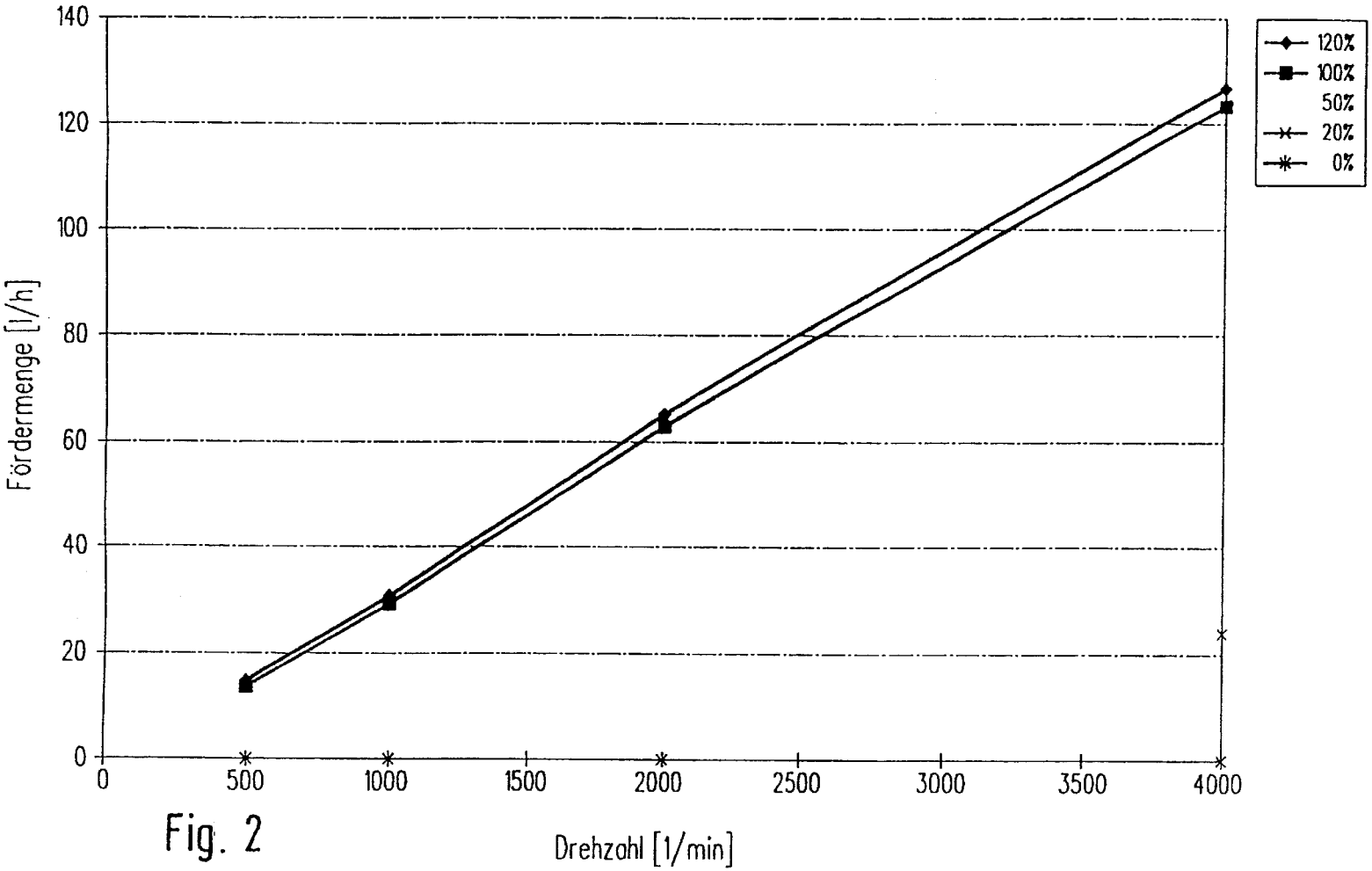
FIG. 2 shows the delivery quantity of the high-pressure pump with the volume flow control at various throttling intensities.
Figure 3:
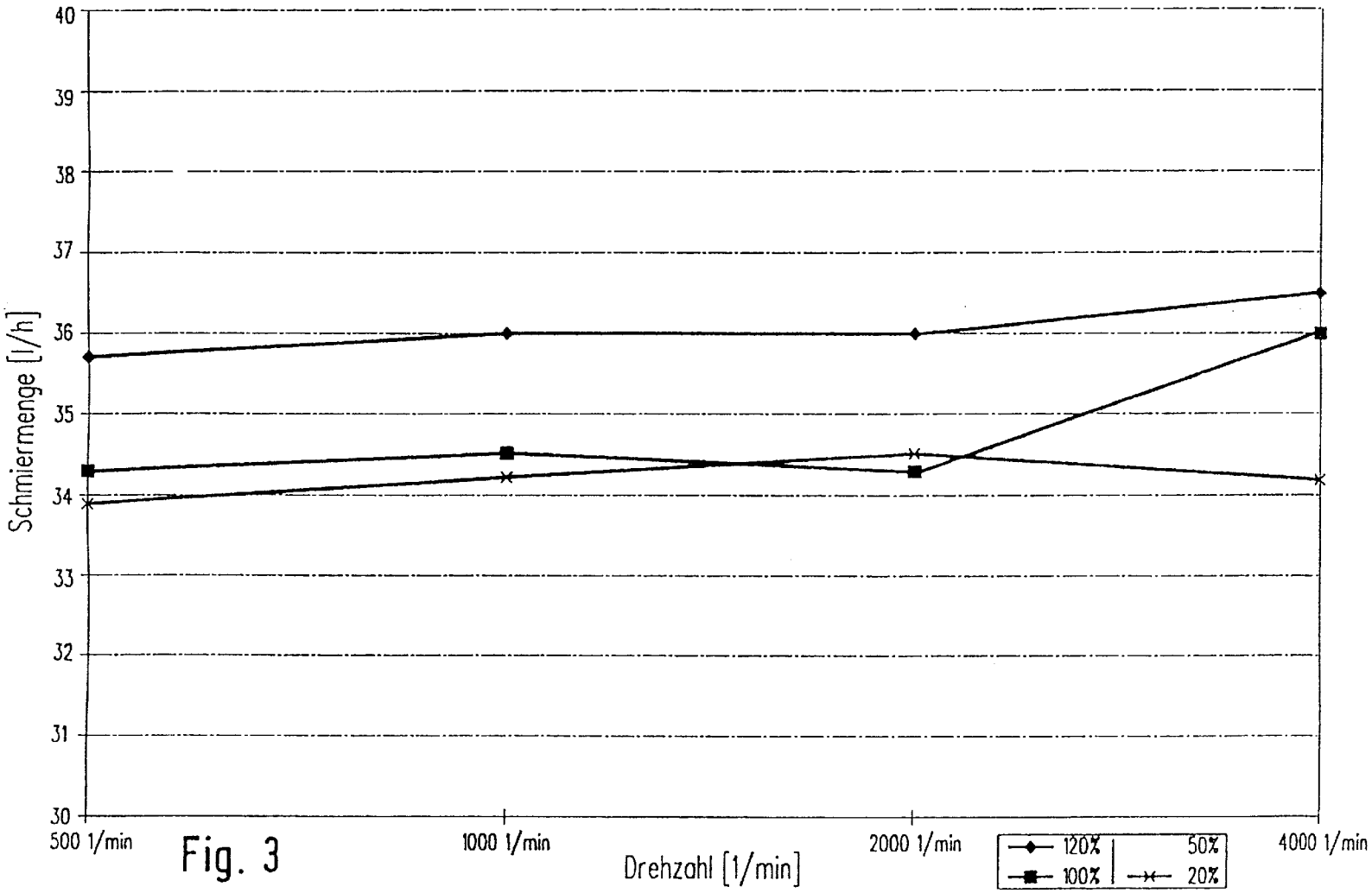
FIG. 3 shows the supplied lubricant quantity as a function of the speed of the high-pressure pump at various throttling intensities.

FIGS. 2 and 3 show the fuel quantity delivered by the high-pressure pump 14 as a function of the speed of the high-pressure pump 14 at a varying throttling intensity, wherein the throttling intensity is produced from the quotient of the excess quantity $Q_z$, delivered by the electric fuel pump in relation to the geometric delivery volume of the high-pressure pump $Q_H$ (throttling intensity=$Q_Z/Q_H\times 100\%$), wherein the excess quantity $Q_Z$ is understood to be the fuel quantity delivered by the low-pressure pump minus the lubricant quantity.

Figure 4:
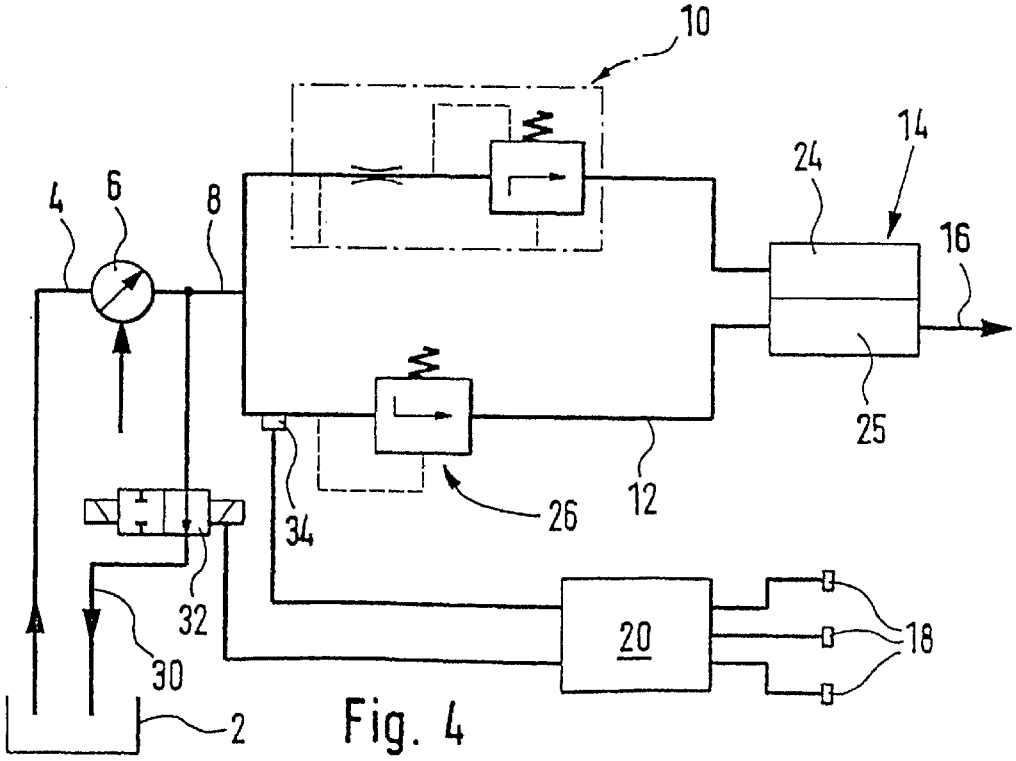
FIG. 4 shows a schematic representation o the low-pressure circuit of the system according to the invention for generating high fuel pressure with delivery pressure control.

FIG. 4 shows another embodiment of a delivery pressure-controlled low-pressure circuit, in which the low-pressure pump 6' is constituted by a gear pump with a subsequently connected pressure regulation. In order to regulate the pressure on the delivery side of the gear pump, a branch line 30 is provided, which leads back to the tank 2, wherein a synchronized solenoid valve 32 is provided in the branch line 30. Furthermore, a pressure sensor 34 is provided, which cooperates with the control device 20. The output signal of the control device 20 in this instance is a control signal for the solenoid valve 32, which as a function of the measurement value of the pressure sensor 34, controls or regulates a predetermined pressure on the delivery side of the low-pressure pump 6' as a function of the required fuel quantity.

Figure 5:
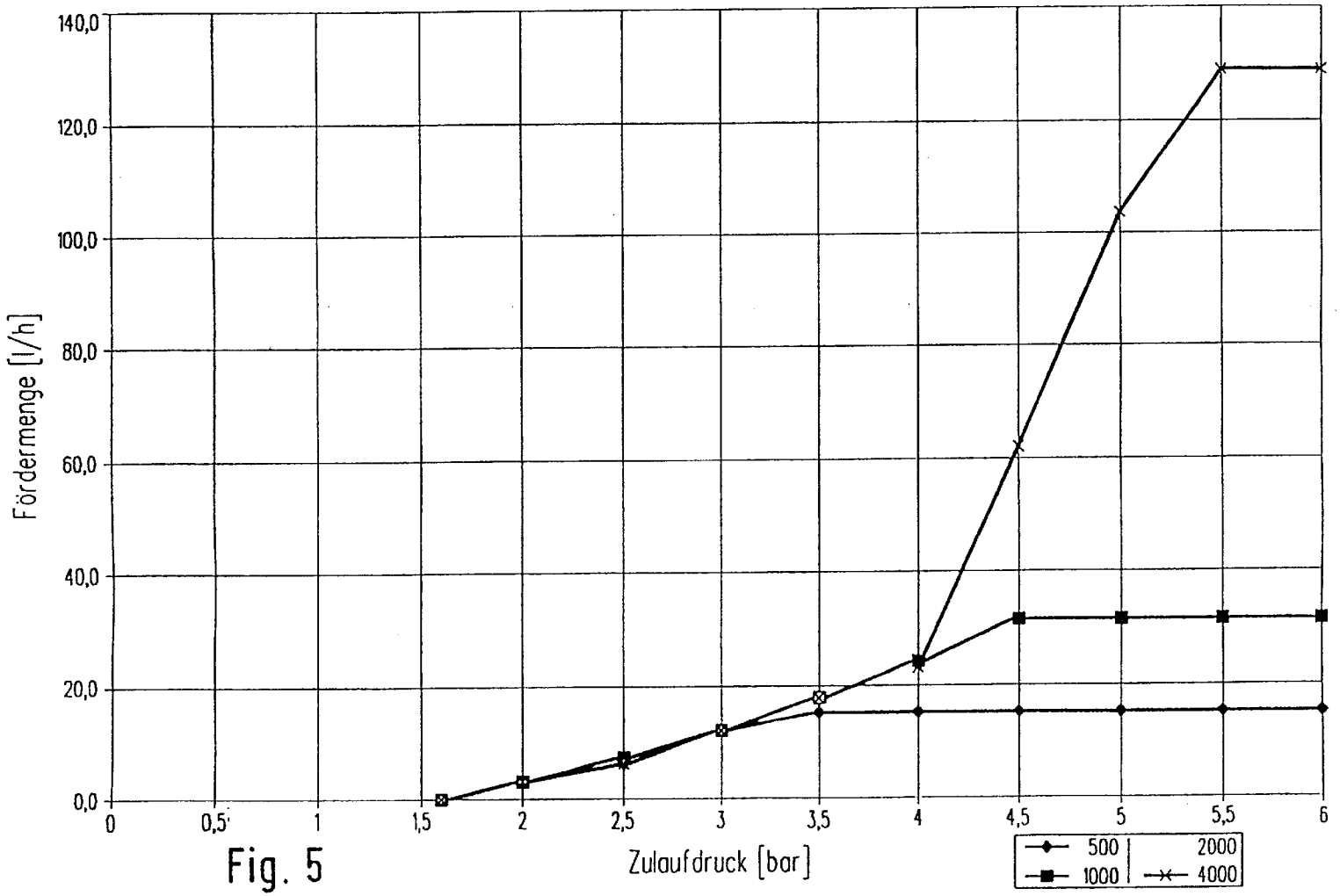
FIG. 5 shows the delivery quantity of the high-pressure pump as a function of the inlet pressure on the intake side with different speeds of the high-pressure pump.
Figure 6:
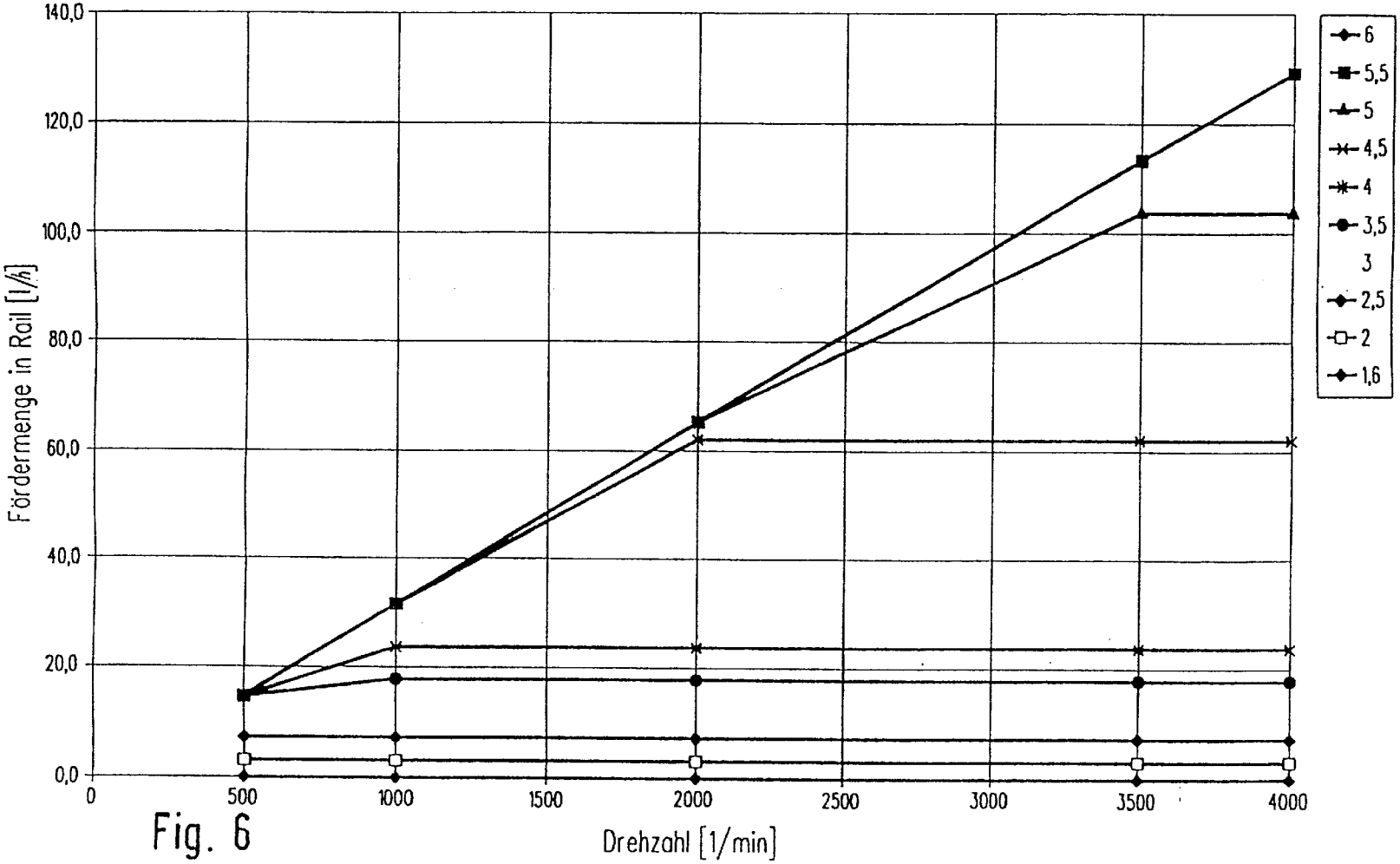
FIG. 6 illustrates the delivery quantity of the high-pressure pump as a function of the speed at various inlet pressures.
Figure 7:
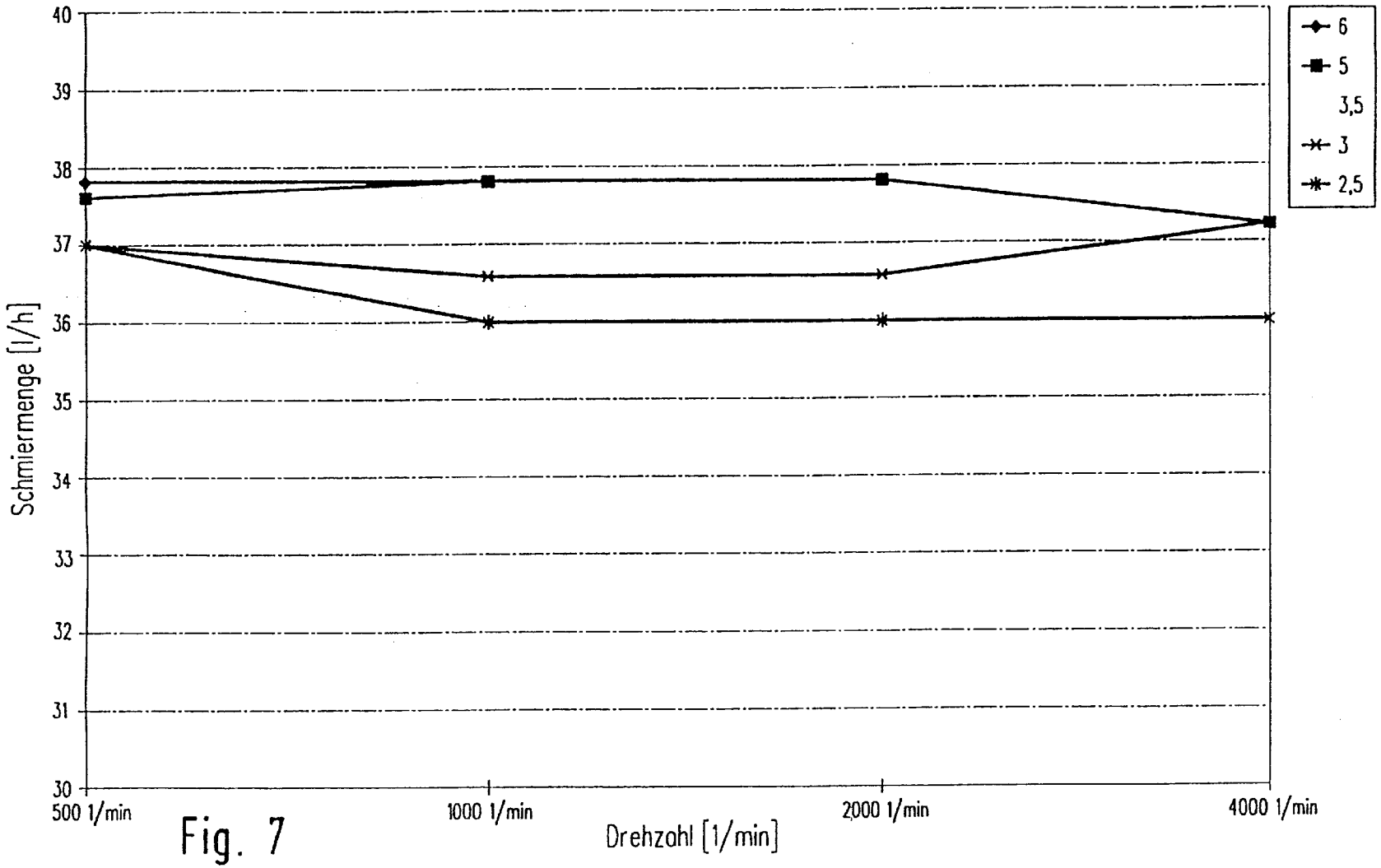
FIG. 7 shows the supplied lubricant quantity as a function of the speed of the high-pressure pump with a varying inlet pressure.

FIGS. 5 and 6 depict the delivery quantity of the high-pressure pump with the delivery pressure regulation in the low-pressure circuit according to FIG. 4 as a function of the inlet pressure at various speeds or as a function of the speed at various inlet pressures. FIG. 7 shows the lubricant quantity as a function of the speed at various inlet pressures; the lubricant quantity is essentially independent of the high-pressure pump speed and the inlet pressure. It should be noted that the depictions of the delivery quantities or lubricant quantities are calculated amounts.

The foregoing relates to preferred exemplary embodiments of the invention, it being understood that other variants and embodiments thereof are possible within the spirit and scope of the invention, the latter being defined by the appended claims.

What is claimed is:

1. A process for generating and delivering high-pressure fuel to a high-pressure storage chamber of a fuel injection system of an internal combustion engine, which comprises delivering fuel from a tank via a low pressure pump as a pre-feed pump to an intake side of a high-pressure pump, delivering a part of the fuel delivered by the low-pressure pump to the high pressure pump to lubricate the high-pressure pump, controlling the delivery quantity of the low-pressure pump or the delivery pressure on the delivery side of the low-pressure pump as a function of a currently required fuel quantity determined by sensors and a control device, and branching off from the delivery flow of the low-pressure pump a constant lubrication flow quantity, which is essentially independent of the pressure on the delivery side, and delivering a residual remainder flow of the fuel to the intake side of the high-pressure pump.

2. A system for generating high fuel pressure in a common rail of a fuel injection system of an internal combustion engine, comprising a low-pressure pump (6) that aspirates fuel from a tank (2), a high-pressure pump (14) that is fed by the low-pressure pump (6) and feeds fuel into a high-pressure storage chamber, and a lubricating circuit that uses the fuel, which is to be delivered, as a lubricant for lubricating the high-pressure pump (14), in which the low-pressure pump (6) is volume flow controlled by a control device (20) with which a volume flow that corresponds to a currently required fuel quantity adjusted in the low-pressure pump (6), and a delivery side (8) of the low pressure pump (6) communicates with a flow regulating valve (10) that leads to the lubrication circuit of the high-pressure pump and parallel to the flow regulating valve communicates with the intake side (12) of the high-pressure pump (14).

3. The system according to claim 2, in which the low-pressure pump (6) is an electric fuel pump that includes a speed control means.

4. The system according to claim 3, in which a speed sensor (22) that is associated with the speed-controlled electric fuel pump cooperates as a feedback with the control device (20) so that a speed regulation of the electric fuel pump is achieved.

5. A system for generating high fuel pressure in a common rail of a fuel injection system of an internal combustion engine, comprising a low-pressure pump (6') that aspirates fuel from a tank (2), a high-pressure pump (14) that is fed by the low-pressure pump (6) and feeds fuel into a high-pressure storage chamber, and a lubricating circuit that uses the fuel which is delivered as a lubricant for lubricating the high-pressure pump (14), and a delivery pressure on the delivery side of the low-pressure pump (6') is controlled by a control device (20) as a function of a currently required fuel quantity, and that the delivery side of the low-pressure pump (6') communicates with a flow regulating valve (10) that leads to the lubrication circuit of the high-pressure pump (14) and parallel to the lubrication circuit of the high-pressure pump (14) communicates with the intake side (12) of the high-pressure pump (14).

6. The system according to claim 5, in which the low-pressure pump (6') is pressure regulated and controlled by the control device (20).

7. The system according to claim 5, in which the low-pressure pump (6') is constituted by a gear pump with a subsequently connected variable throttle device that is controlled by the control unit (20).

8. The system according to claim 7, in which the subsequently connected variable throttle device is a throttle slide valve.

9. The system according to claim 7, in which the subsequently connected variable throttle device is a synchronized solenoid valve (32) that is controlled by the control device (20) and is provided in a branch line (30) that leads back to the tank (2).

10. The system according to claim 2, which includes a safety valve (26) on the delivery side of the low-pressure pump (6, 6'), which interrupts the fuel delivery to the high-pressure pump (14) when the pressure falls below a predetermined level.

11. The system according to claim 3, which includes a safety valve (26) on the delivery side of the low-pressure pump (6, 6'), which interrupts the fuel delivery to the high-pressure pump (14) when the pressure falls below a predetermined level.

12. The system according to claim 4, which includes a safety valve (26) on the delivery side of the low-pressure pump (6, 6'), which interrupts the fuel delivery to the high-pressure pump (14) when the pressure falls below a predetermined level.

13. The system according to claim 5, which includes a safety valve (26) on the delivery side of the low-pressure pump (6, 6'), which interrupts the fuel delivery to the high-pressure pump (14) when the pressure falls below a predetermined level.

14. The system according to claim 6, which includes a safety valve (26) on the delivery side of the low-pressure pump (6, 6'), which interrupts the fuel delivery to the high-pressure pump (14) when the pressure falls below a predetermined level.

15. The system according to claim 7, which includes a safety valve (26) on the delivery side of the low-pressure pump (6, 6'), which interrupts the fuel delivery to the high-pressure pump (14) when the pressure falls below a predetermined level.

16. The system according to claim 8, which includes a safety valve (26) on the delivery side of the low-pressure pump (6, 6'), which interrupts the fuel delivery to the high-pressure pump (14) when the pressure falls below a predetermined level.

* * * * *